US005615561A

United States Patent [19]

Houshmand et al.

[11] Patent Number: 5,615,561

[45] Date of Patent: Apr. 1, 1997

[54] LNG PRODUCTION IN CRYOGENIC NATURAL GAS PROCESSING PLANTS

[75] Inventors: Mory Houshmand; Kimberly A. Kruger, both of Salt Lake City, Utah; Gerald W. Alves; Ricardo Ostaszewski, both of Sugar Land, Tex.; Noureddine Belhateche, Katy, Tex.

[73] Assignee: Williams Field Services Company, Salt Lake City, Utah

[21] Appl. No.: 335,902

[22] Filed: Nov. 8, 1994

[51] Int. Cl.[6] ..... F25J 1/00

[52] U.S. Cl. ..... 62/611; 62/620

[58] Field of Search ..... 62/9, 11, 13, 23, 62/42, 24, 620, 611

[56] References Cited

U.S. PATENT DOCUMENTS

| | | | |
|---|---|---|---|
| 3,195,316 | 7/1965 | Maher et al. | 62/52 |
| 3,299,646 | 1/1967 | Stuart et al. | 62/40 |
| 3,724,226 | 4/1973 | Pachaly | 62/39 |
| 3,735,600 | 5/1973 | Dowdell et al. | 62/39 |
| 4,033,735 | 7/1977 | Swenson | 62/9 |
| 4,274,849 | 6/1981 | Garier et al. | 62/9 |
| 4,339,253 | 7/1982 | Caetani et al. | 62/40 |
| 4,456,459 | 6/1984 | Brundige, Jr. | 62/9 |
| 4,539,028 | 9/1985 | Paradowski et al. | 62/9 |
| 4,566,885 | 1/1986 | Haak | 62/9 |
| 4,680,041 | 7/1987 | DeLong | 62/23 X |
| 4,687,499 | 8/1987 | Aghili | 62/42 X |
| 4,711,651 | 12/1987 | Sharma et al. | 62/23 X |
| 4,746,342 | 5/1988 | DeLong et al. | 62/24 |
| 4,805,413 | 2/1989 | Mitchell et al. | 62/42 X |
| 5,036,671 | 8/1991 | Nelson et al. | 62/23 |
| 5,089,034 | 2/1992 | Markovs et al. | 55/28 |
| 5,275,005 | 1/1994 | Campbell et al. | 62/24 |
| 5,359,856 | 11/1994 | Rhoades et al. | 62/9 |
| 5,363,655 | 11/1994 | Kikkawa et al. | 62/9 |
| 5,402,645 | 4/1995 | Johnson et al. | 62/23 |

OTHER PUBLICATIONS

"LNG Supply", LNG Express, vol. IV, No. 1, pp. 1–4, Copyright 1994, Zeus Development Corporation.

*Primary Examiner*—Christopher Kilner

*Attorney, Agent, or Firm*—Eleanor V. Goodall; Jon C. Christiansen

[57] ABSTRACT

A method and system for liquifying natural gas using a cryogenic process is described. The method is well suited for producing high methane purity natural gas which can be used as a vehicle fuel. The invention utilizes residue gas from a cryogenic plant as a natural gas feedstock. The natural gas feedstock is condensed by heat exchange with overhead gas from the demethanizer of the cryogenic plant. In the preferred embodiment of the invention the pressure of the condensed natural gas is reduced to a level at which it can be readily stored and transported by expansion through one or more Joule-Thomson valves.

59 Claims, 5 Drawing Sheets

LNG PRODUCTION IN CRYOGENIC NATURAL GAS PROCESSING PLANTS

BACKGROUND OF INVENTION

A. Field of the Invention

This invention relates to a new and useful method for liquifying natural gas. In particular, this invention relates to a method for producing liquid natural gas (LNG) having a high methane purity, which is well suited for integration with cryogenic gas processing plants used to recover natural gas liquids (NGLs).

Natural gas that is recovered from petroleum reservoirs is normally comprised mostly of methane. Depending on the formation from which the natural gas is recovered, the gas will usually also contain varying amounts of hydrocarbons heavier than methane such as ethane, propane, butanes, and pentanes as well as some aromatic hydrocarbons. Natural gas may also contain non-hydrocarbons, such as water, nitrogen, carbon dioxide, sulfur compounds, hydrogen sulfide, and the like.

It is desirable to liquify natural gas for a number of reasons: natural gas can be stored more readily as a liquid than in the gaseous form, because it occupies a smaller volume and does not need to be stored at high pressures; LNG can be transported in liquid form by transport trailers or rail cars; and stored LNG can be revaporized and introduced into a pipeline network for use during peak demand periods.

LNG which has been highly purified (i.e. about 95 to 99 mol % methane purity) is suitable for use as vehicular fuel, since it is clean burning, costs significantly less than petroleum or other clean fuels, provides almost the same travel range between fill-ups as gasoline or diesel, and requires the same fill-up time. High methane purity LNG can also be economically converted into compressed natural gas (CNG), another clean, economical vehicle fuel. The need for economical, clean-burning fuels such as LNG is particularly urgent because the Clean Air Act Amendment (CAAA) and the Energy Policy Act of 1992 are forcing companies with large vehicle fleets operating in areas with ozone problems, railroads, and some stationery unit operators to convert to cleaner burning fuels.

B. The Background Art

A number of methods are known for liquifying natural gas (consisting mainly of methane with minor concentration of ethane and heavier hydrocarbons). These methods generally include steps in which the gas is compressed, cooled, condensed, and expanded. Cooling and condensing can be accomplished by heat exchange with several refrigerant fluids having successively lower boiling points ("Cascade System"), for example as described in Haak (U.S. Pat. No. 4,566,459) and Maher et al. (U.S. Pat. No. 3,195,316). Alternatively, a single refrigerant may be used at several different pressures to provide several temperature levels. A single refrigerant fluid which contains several refrigerant components ("Multi-Component System") may also be used. A typical combination of refrigerants is propane, ethylene and methane. Nitrogen is sometimes used as well. Swenson (U.S. Pat. No. 4,033,735), Garier et al. (U.S. Pat. No. 4,274,849), Caetani et al., (U.S. Pat. No. 4,339,253), and Paradowski et al. (U.S. Pat. No. 4,539,028) describe variants of the Multi-Component refrigeration approach. Expansion is generally isenthalpic (via a throttling device such as a Joule-Thomson valve) or isentropic (occurring in a work-producing expansion turbine).

Despite the availability of these methods, there are very few facilities in the United States that can produce significant amounts of vehicular grade LNG. In principle, any of the above methods can be used to liquify natural gas. However, the capital cost of constructing and maintaining refrigeration systems for producing LNG can be high. Auxiliary refrigeration systems have high energy expenses, using considerable amounts of fuel gas or electricity and producing significant air emissions (if fuel gas is used).

The various existing LNG production processes and possibility of producing LNG at various types of natural gas processing plants will now be considered. It will be seen that there remains a need for an economical liquifaction process which is compatible with commonly available types of natural gas processing plants and which makes it feasible to produce LNG in the large volumes and with the high purity which would be necessary for it to be practical as a vehicle fuel (see also "LNG Supply", LNG Express, Volume IV, No 1, pp. 1–4, January 1994, for further discussion of the need for increased vehicle grade LNG production in the U.S., possible methods for producing LNG, and the desirability of modifying existing plants to produce LNG).

LNG Peak Shaving Plants are used to liquify natural gas which is stored for later use during peak demand periods, to insure that municipal gas distribution grids have adequate gas supplies during severely cold weather. These plants typically utilize cascade or multi-component refrigeration systems to liquify pipeline quality gas. LNG Peak Shaving Plants produce the majority of LNG in the U.S., but only a fraction of their capacity is available for transportation use. Furthermore, most peak shavers do not produce an LNG product with a high enough methane content to be used as a vehicle fuel. LNG Peak Shavers usually liquefy pipeline quality gas which typically contains too much ethane and heavier hydrocarbons to make a vehicle grade LNG product.

Pachaly (U.S. Pat. No. 3,724,226) describes a plant which combines cryogenic fractionation with an expander cycle refrigeration process to produce LNG. The intended purpose of this plant is the liquifaction of natural gas at remote locations in order to facilitate transportation. This plant does not, however, produce high methane-purity LNG and furthermore the design is such that operating costs will be high.

"Grass Roots" or dedicated LNG plants are new plants designed and installed specifically for the purpose of producing vehicle grade LNG. These plants may have various designs, but all tend to use auxilliary refrigeration systems like those described above. The main disadvantage of this type of plant is that installing a new facility is more expensive than modifying an existing facility.

Nitrogen Rejection Units (NRUs) utilize cryogenic fractionation to liquify methane and separate it from gaseous nitrogen. NRUs are used at sites where the natural gas has a high nitrogen content, either naturally occurring or because nitrogen was injected into the petroleum reservoir to maintain reservoir pressure and increase the recovery of oil and/or gas. The methane purity of the LNG produced at these plants is often sufficiently high for use as a vehicle fuel. However, there are not a large number of these sites and they are often in remote areas, so NRUs do not represent a major source of LNG in the United States. In addition, they require the use of a large amount of auxiliary refrigeration.

Another type of plant which processes natural gas is the natural gas liquid (NGL) plant, which is used to recover NGLs. NGL recovery comprises liquifying and separating the heavier hydrocarbon components of natural gas (ethane, propane, butanes, gasolines, etc.) from the primarily methane fraction which remains in gaseous form (residue gas). The heavier hydrocarbons are worth more commercially as liquids than as natural gas. NGLs are sold as petrochemical feedstocks, gasoline blending components, and fuel. These plants also typically remove non-hydrocarbons such as water and carbon dioxide to meet gas pipeline restrictions on these components. There are hundreds of such NGL plans throughout the U.S. NGL plants include lean oil absorption plants, refrigeration plants, and cryogenic plants. To the best of the inventors knowledge, such plants are not presently used to produce LNG (liquid natural gas). However, if a cost effective process for liquifying the residue natural gas could be integrated with these plants, NGL gas processing plants could become a significant source of vehicle fuel in the U.S.

Existing LNG Peak Shavers, NRUs and natural gas processing plants used to recover NGLs may be modified to produce vehicular grade LNG fuel by the addition of fractionation systems and auxiliary refrigeration systems. Additional cryogenic distillation systems may be used to increase the LNG purity by removing ethane and heavier hydrocarbons from natural gas in order to produce fuel quality LNG. However, since installation of fractionators and auxiliary refrigeration systems is very expensive, this is not always an economically feasible approach for producing high-purity LNG suitable for vehicle fuel.

We have discovered a novel manner in which a basic cryogenic NGL plant design can be modified to make a plant for producing high methane purity LNG without the need for additional fractionation and refrigeration systems.

SUMMARY OF THE INVENTION

The invention is a process design for producing liquified natural gas (LNG), which in the preferred embodiment of the invention is a high methane purity form of LNG that can be used as vehicular fuel. Although less preferred, the invention may also be used for producing lower purity LNG.

The process can be incorporated with existing cryogenic natural gas liquid plants. The invention can also be used in new cryogenic plants. The term cryogenic refers to plants which operate at temperatures below −50 degrees Fahrenheit. Not all cryogenic plants are NGL plants. However, the term cryogenic, as used herein, will always refer to cryogenic plants used to produce NGLs. The inventive process produces LNG by liquifying a slipstream of the residue gas exiting a cryogenic plant. The slipstream is preferably first compressed in the cryogenic plant residue gas compressor. The slipstream is condensed to a liquid utilizing the cryogenic plant's demethanizer overhead gas (or comparable cold gas stream from the plant) as a cooling medium. The condensed liquid is then isenthalpically expanded at a series of progressively lower pressures using the Joule-Thomson (JT) effect to bring the LNG to a temperature and pressure at which it can be conveniently stored and transported.

The invention offers gas processors a low cost, simple and effective means to retrofit their existing facilities to produce LNG and requires only minor equipment additions. Both capital and energy costs are minimized. A key advantage of retrofitting gas processing plants, especially cryogenic plants, to produce LNG is the gas purity of the feedstock available from these facilities. The invention is especially well suited for cryogenic plants with high ethane recoveries, which produce a residue gas which easily meets the required high methane purity and low ethane restriction in LNG used as vehicle fuel. However, plants designed for low ethane recoveries may be used with some additional modifications.

Natural gas often contains heavy hydrocarbons and non-hydrocarbons, water and $CO_2$ in particular, which must be removed prior to liquefaction. Heavy hydrocarbons reduce the LNG purity and make it unusable for vehicle fuel due to the pre-ignition problems that arise, while $CO_2$ and water will cause freeze-ups and hydrate formation, respectively, in the LNG liquefaction process. Cryogenic plants typically have the equipment in place to remove $CO_2$, water and the heavy hydrocarbons (as NGLs). In these cases, the cost of pretreatment of the feedstock for the liquefaction process can be eliminated. The cost of pretreatment is a major capital cost of new LNG liquefaction facilities.

The invention also uses the cooling capabilities of the cold demethanizer overheads stream to condense the LNG feedstock, eliminating or reducing the need for an auxiliary refrigeration system. Depending on the relative capacity of the cryogenic plant and the LNG production rate, small additions to the existing NGL plant refrigeration system may be required.

If the goal is to produce LNG for peak shaving purposes (to be vaporized and introduced into pipelines to meet peak demand periods), ethane recovery is not critical and the invention can be integrated with almost any cryogenic plant.

One object of the invention is to provide a method for the liquifaction of natural gas which requires a lower investment of capital than do conventional refrigeration or fractionation retrogrades to existing cryogenic plants. Another object of the invention is to provide a method for the liquifaction of natural gas which requires less energy and lower operating costs than systems which use conventional refrigeration systems. Yet another object of the invention is to provide a method for manufacturing liquid natural gas which has a very consistent, high methane purity and which could be used as a vehicle fuel.

DETAILED DESCRIPTION OF THE INVENTION

The invention is a method and system for liquifying natural gas. In particular, this method is well-suited for producing liquid natural gas having a high methane purity. The invention can be used with almost any plant which utilizes a cryogenic process to recover natural gas liquids. The two major types of cryogenic plants that can be integrated with the invention are turboexpander plants (TXPs) and Joule-Thomson (JT) plants. The differences between these two types of plants will be discussed subsequently.

The invention is preferably implemented in combination with an existing cryogenic plant. However, the invention can be incorporated into the design of new plants as well.

Detailed Description

Figure 1:
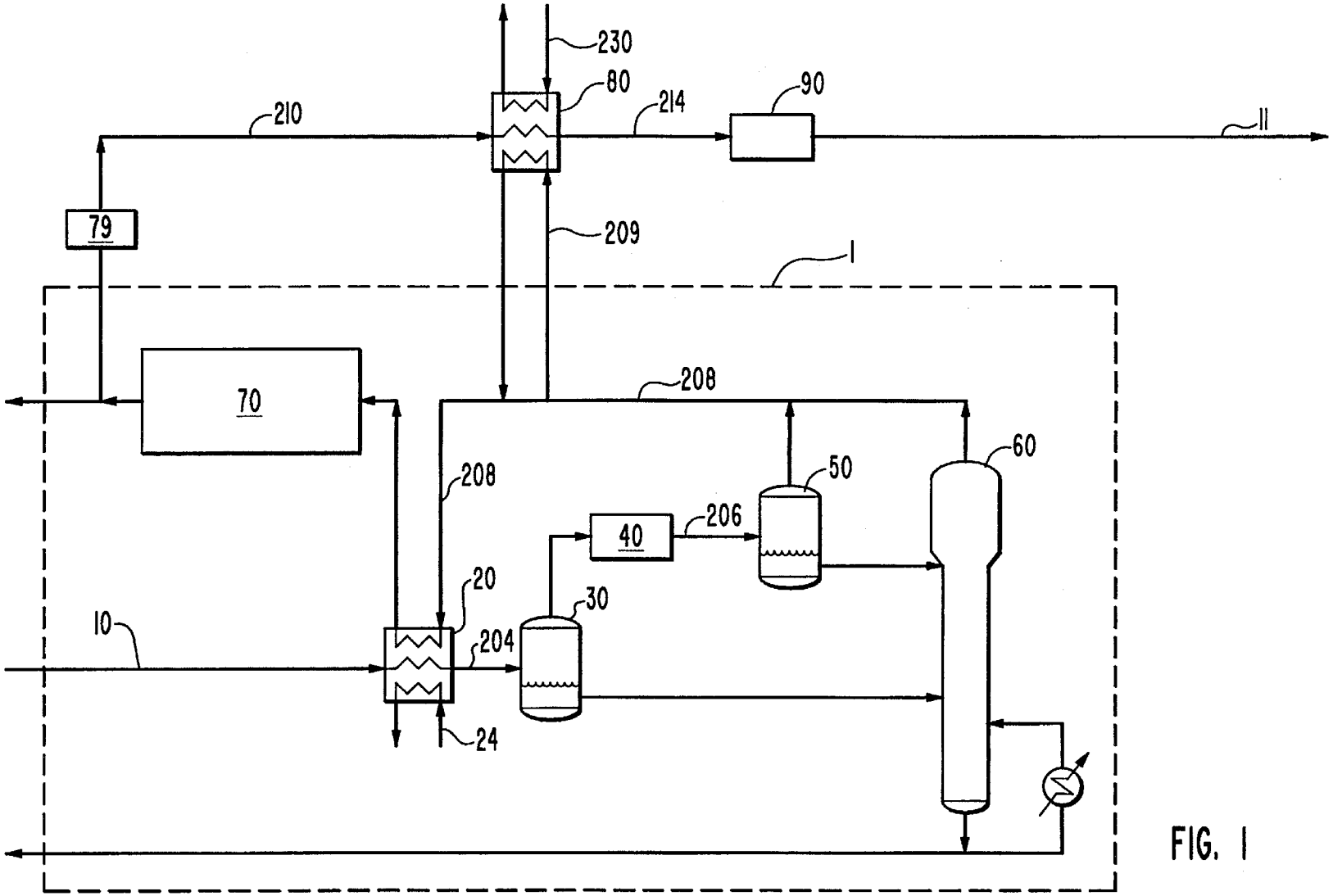
FIG. 1 is a schematic diagram of the invention and a cryogenic plant with which it is used.

FIG. 1 is a schematic diagram showing the invention used in combination with a typical cryogenic plant. Inlet cooling train 20, expansion inlet separator 30, expansion means 40, expansion outlet separator 50, liquid fractionation means 60, and residue gas compressor 70 are components of cryogenic plant 1. Said components are common to most cryogenic plants. The boundaries of cryogenic plant 1 are indicated by a dashed line. The natural gas feedstock (i.e. the plant feedstock) is introduced at inlet 10 and cooled in inlet cooling train 20 which causes some of the heavier hydrocarbon components to condense so that the resulting cooled natural gas is a first gas/liquid mixture. Inlet cooling train 20 may consist of one or more of the following types of heat exchangers: plate fin heat exchanger, shell and tube heat exchanger, or chiller with refrigeration; or other heat exchanger(s). These exchangers can utilize overhead gas 208 from liquid fractionation means 60, a supplementary refrigerant 24, such as propane, or the liquid from liquid fractionation means 60 as a cooling medium.

Said first gas/liquid mixture is separated into a first liquid fraction and a first gas fraction in expansion inlet separator 30, which is a conventional two-phase separator or comparable separation means. Said first gas fraction is routed to expansion means 40, where it is expanded to cause cooling and reduction of pressure, thereby forming a second gas/liquid mixture. Expansion means 40 is preferably a turboexpander (in a turboexpander plant); alternatively, it may comprise one or more Joule-Thomson (JT) valves or some other expansion means. Said second gas/liquid mixture produced in said expansion means travels via line 206 to expansion outlet separator 50, which may be a two-phase separator or may be the enlarged top portion of a demethanizer (which functions as a two-phase separator) where it is separated into a second gas fraction and a second liquid fraction. Said second liquid fraction from expansion outlet separator 50 and said first liquid fraction from expansion inlet separator 30 are introduced to liquid fractionation means 60. Liquid fractionation means 60 is usually known as a demethanizer, but may also be referred to as a fractionation column with reboiler options and/or an overhead condenser.

The main purpose of liquid fractionation means 60 is to remove the methane which may have condensed with the liquids formed during the expansion. Liquid fractionation means 60 separates overhead gas (also called residue gas) comprising primarily methane, from heavier hydrocarbons such as ethane, butane, propane, etc. which exit fractionation means 60 as liquids. In a general sense, expansion inlet separator 30, expansion means 40, expansion outlet separator 50 and liquid fractionation means 60 together serve as a fractionation means, and some other arrangement of similar components could be used to perform the same fractionation function (e.g. separation of premarily methane gas from heavier hydrocarbon liquids). Although the configuration shown here is preferred, and is most commonly found in cryogenic plants, any other configuration of components which performed a fractionation function can alternatively be used in the practice of the invention.

Overhead stream 208 (overhead gas and/or said second gas fraction from expansion outlet separator 50) is used as a coolant in the inventive process. Overhead stream 208 is used as a coolant because it provides the lowest temperature available in the cryogenic plant and permits liquefaction of the residue gas stream at moderate pressure. The invention is preferably used in cryogenic plants in which overhead stream 208 has a temperature of about −200 to −100 degrees F. and a pressure of 100 to 600 psig. A slipstream 209 of overhead stream 208 serves as a coolant in residue gas condenser 80. Overhead stream 208 is preferably also used as a cooling medium in inlet cooling train 20. Overhead stream 208 is compressed in compression train 70. In the case that expansion means 40 is a turboexpander, compression train 70 preferably comprises the booster compressor of said turboexpander plus one or more additional compressors (various types of compressors may be used, for example centrifugal compressors, reciprocating compressors, screw compressors, or other compressors) to provide further compression. In the case that expansion means 50 is something other than a turboexpander, compression train 70 comprises one or more compressors of the types listed above, or similar, but no turboexpander-driven booster compressor.

A slipstream 210 of the compressed overhead stream (residue gas) is used as feed gas to residue gas condenser 80, where it is condensed to form condensed stream 214, which comprises liquid natural gas which has been cooled to its bubble point, or to a lower temperature. Slipstream 210 typically has a temperature between about 0 and about 400 degrees F. and a pressure between about 100 and about 1200 psig. It is preferable that slipstream 210 has a temperature between about 20 and about 200 degrees F. and a pressure between about 300 and 900 about psig. Slipstream 210 is also referred to as condenser feedstock 210.

Residue gas condenser 80 is cooled by slipstream 209 and optionally other cold gas streams taken from other stages in the cryogenic or LNG plant, or by an auxilliary refrigerant stream 230. Condenser feedstock 210 is condensed in residue gas condenser 80 to its bubble point temeprature, or below. Condensed stream 214 is typically at a pressure of about 100 to 700 psig, with associated bubble point temperatures of −203 to −100 degrees F., and preferably at a pressure of about 300 to 700 psig, with associated bubble point temperatures of −159 to −100 degrees F. Condensed stream 214 is expanded in expansion means 90 to further reduce the temperature and pressure of the LNG. During the expansion a minor portion of the liquid is vaporized.

Expansion means 90 preferably comprises one or more flash drums into which the natural gas stream is isenthalpically expanded ("flashed") using the Joule-Thomson (JT) effect. Alternatively, said expansion means could also comprise an expander. The expansion step carried out in expansion means 90 reduces the pressure of said liquid natural gas to a level at which it can be conveniently stored and transported. The LNG product will typically have a pressure of about 0.0 to 100 psig and temperature of about −259 to −200 degrees F., and preferably have a pressure of about 0.5 to 10 psig and temperature of about −258 to −247 degrees F. LNG product may be taken from outlet 11 for storage or transportation or any other desired use.

In order for the invention to be integrated with an existing cryogenic plant, it is necessary that the cryogenic plant meet certain specifications (e.g. that it have certain components and certain operating conditions). In addition, it is important that the invention be integrated with the existing plant in such a way that the operation of the existing plant in its original capacity (e.g. production of natural gas liquids, etc. ) is not degraded. Assuming that-the cryogenic plant design is suitable for integration with the invention, the details of the preferred embodiment of the invention depend on the design of the cryogenic plant with which it is to be integrated. The best mode of the invention is therefore determined taking into account the following guidelines.

Many variables affect the quantity and quality of LNG produced with the invention as well as the energy requirements. Discussed below are how the condenser feedstock quality, condenser feedstock pressure, condensing temperature, and the number of expansion stages affect the invention. Also discussed are the typical operating parameters for the invention. The temperatures and pressures throughout a given plant can be estimated with the use of Process Simulation Modelling. Software for performing such simulations is readily available (for example: HYSIM™, CHEMSHARE™, and PROSIM™) and familiar to those of ordinary skill in the art.

Condenser Feedstock Quality

The condenser feedstock (that is, the slipstream of the compressed residue gas from the cryogenic plant) should contain less than 50 ppm of carbon dioxide and be virtually free of water to prevent $CO_2$ freeze-ups and hydrate formation from occurring in the LNG liquefaction process. Water is typically removed from natural gas upstream of the cryogenic plant by glycol dehydration (absorption) followed by a molecular sieve (adsorption) bed. Alternatively, a molecular sieve bed alone, or other conventional methods, may be used to remove the water. Molecular sieve dehydration units are normally installed upstream of the cryogenic plant to eliminate the water before the gas enters the cooling train.

If the natural gas is not treated at the inlet of the cryogenic plant to remove $CO_2$, it may be necessary to install a $CO_2$ removal system 79 for removing $CO_2$ from the residue gas which is used as a feedstock for the inventive process, in which case said $CO_2$ removal system 79 would be placed between the outlet of the compression train 70 and the inlet of the residue gas condensor 80. Some of the possible treating systems which might be installed to remove the $CO_2$ are an amine system or a molecular sieve. If an amine system is used, the outlet gas from this system must also be dehydrated. These methods are well known to persons of ordinary skill in the art.

Before feed gas is introduced into the turboexpander or JT plant, the gas may be treated to remove non-hydrocarbon components such as hydrogen sulfide ($H_2S$), sulfur, mercury, etc. if present in quantities that may adversely effect the operation of the cryogenic plant. Numerous methods which can be used to remove these components are known to persons of ordinary skill in the art and will not be discussed here.

The amount of methane, inert gases (such as nitrogen), ethane, and hydrocarbons heavier than ethane in the condenser feedstock will determine the quality of LNG produced. The flash gases produced during the process will be predominantly methane with a high percentage of nitrogen, while the ethane and heavy hydrocarbons will stay in liquid form throughout the LNG liquefaction process. Consequently, the ethane and heavy hydrocarbons tend to concentrate in the LNG, so that the molar fraction of ethane and heavy hydrocarbons in the LNG contained in the storage tank will be higher than that of the condenser feedstock. It is preferred that the cryogenic processes integrated with the invention is capable of removing high percentages of the ethane and essentially all propane and heavier hydrocarbons from the cryogenic plant inlet stream in order to meet the high methane purity required for LNG vehicle fuel. The plant feedstock composition and ethane recoveries required will depend on the desired LNG purity and the LNG process conditions. It may be necessary to modify the cryogenic plant operation to increase ethane recovery. Possibilities for increasing ethane increase ethane recovery. Possibilities for increasing ethane recovery include the installation of an additional fractionator (often called a cold fractionator), modifying the flow scheme with a deep ethane recovery process and/or installing an additional residue gas recompressor which would allow the demathanizer operating pressure to be lowered.

Feed Stream Pressure

The pressure of the condenser feedstock entering the residue gas condenser is critical to the process design as it determines the condensing temperature of the LNG feed stream. Raising the condenser feedstock pressure will also raise the temperature required to liquefy the LNG feed stream. The condensing pressure must be higher than the demethanizer operating pressure but perferably less than the critical pressure of methane (690 psia). The condenser feedstock must be of a high enough pressure that it can be condensed by the cooling available from the demethanizer overheads stream, plus any flash vapors routed to the residue gas condenser and any supplemental refrigeration (if required). As discussed below (see Condensing Temperature), it is desirable to condense the feedstock to its bubble point (100% saturated liquid), or to a lower temperature.

The feed pressure also affects the amount of flash vapors that are produced in the flashing stages. If the condenser feedstock is condensed to its bubblepoint, the higher its pressure, the more flash vapors will be generated during the flashing stages. Increasing the amount of flash vapors also lowers the quality of the final LNG product as the ethane and heavier components concentrate in the LNG product.

Condensing Temperature

The condensing temperature is another critical operating parameter. As noted above, the condenser feedstock is preferably condensed to its bubble point temperature or below at the pressure of the LNG feed stream. The bubble point temperature for a given pressure is defined as the temperature at which the first bubble of vapor forms when a liquid is heated at constant pressure. At the bubble point, the mixture is saturated liquid. If the demethanizer overheads provide sufficient cooling, it is preferred that the feedstock is not just condensed to its bubblepoint but further cooled to subcool the liquid. Sub-cooling the liquid reduces the amount of vapors formed during the expansion steps. Therefore, more liquid will be produced in the liquefaction process. A lower flowrate of the condenser feedstock is then required to produce a given quantity of LNG liquid product if the feedstock is sub-cooled rather than just condensed to its bubblepoint.

Number of Flash Stages

Selecting the number of flash stages effects the quality and quantity of LNG produced. In most cases, the number of flash stages and the flash pressures are set so that the flash vapors can be used in other plant processes, such as the plant fuel systems, without the need for recompression. Alternatively, the flash vapor can be recompressed to the sales pipeline or recycled into the LNG production process should the amount of vapors generated at these levels exceed the plant fuel gas demands. The larger the number of flash chambers used (and thus the finer the increments of pressure between the flash chambers) the less flash vapor is produced and the larger the amount of liquid natural gas which can be retrieved. The amount of flash vapors produced affects the LNG quality as well as the amount of LNG produced (or the amount of feed gas required to produce a given quantity of LNG). As the number of flash stages is increased, the benefits of reducing the amount of flash gas produced at each additional stage deteriorates very quickly, however. As more flash chambers are used, the expense associated with the purchase and maintenance of equipment increases. A compromise must thus be reached between maximizing quantity and quality of LNG and minimizing equipment costs. In the preferred embodiment of the invention of Example 1 (shown in FIG. 2), it was considered optimal to perform three flashes (i.e. into two flash drums and one storage tank). However, a larger or smaller number of flash chambers might be preferable in a different plant, and could be used without departing from the essential nature of the invention.

Refrigeration Capacity

The plant volume must be large enough that the demethanizer overhead is sufficient to provide cooling to both the residue gas condenser and the inlet cooling train. The temperature of the demethanizer overhead and the amount of demethanizer overhead that can be utilized as a cooling medium (with equivalent loss of cooling in the cryogenic plant inlet train) may limit the amount of cooling that can be carried out in the residue gas condenser. By utilizing the demethanizer overheads to condense the residue gas, an equivalent amount of refrigeration is lost in the inlet cooling train of the cryogenic plant and NGL recoveries may be reduced. The cryogenic plant performance under the new conditions needs to be evaluated. To compensate for this loss and to keep the plant natural gas liquid (NGLs) recoveries high, additional refrigeration in the cryogenic plant inlet cooling train may be required. In cases where enough demethanizer and flash vapors are available to cool the LNG feed to its bubblepoint but additional refrigeration would be required to subcool the liquid, the capital required to install such a refrigeration system would probably not be cost effective.

EXAMPLE 1

Figure 2:
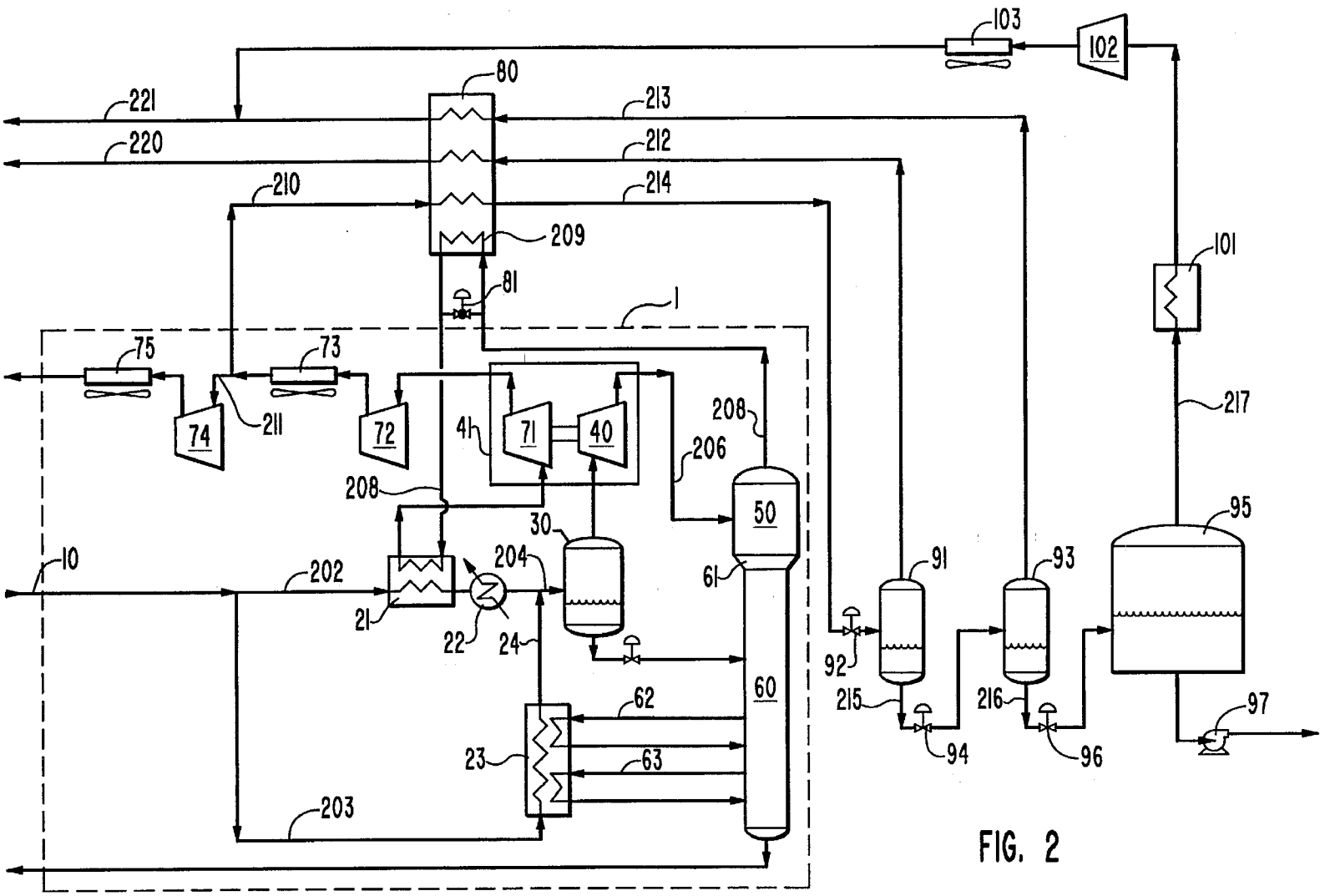
FIG. 2 shows an example of the use of the invention in combination with a turboexpander plant.

The following example is presented to illustrate the operation of the preferred embodiment of the invention more clearly. This embodiment of the invention is depicted in FIG. 2. In this example the invention is integrated with a turboexpander cryogenic plant which was designed for the primary function of processing natural gas to produce natural gas liquids (e.g. ethane, propane, and heavier hydrocarbons, in liquid form) and pipeline quality natural gas. As noted previously, the invention can be used with other plant configurations and the example is intended to illustrate the use of the invention but should not be construed as limiting the invention to use with this particular type of plant.

This turboexpander cryogenic plant processes 350 mmscfd (million standard cubic feed per day) of natural gas. When used in combination with the invention, the plant is capable of producing 10,000 gallons per day of LNG.

The plant feedstock, natural gas which has been previously dehydrated and treated to remove carbon dioxide gas, is introduced at the inlet 10 of the cryogenic plant. Alternatively, carbon dioxide may be removed from the gas at a later stages of the process, however it must be removed before the condensation (liquifaction) steps which take place in residue gas condenser 80, because the low temperatures employed will cause $CO_2$ freeze-ups in the LNG process. The plant feedstock has a molar composition of 92.76 mol % methane, 4.39 mol % ethane, 1.52 mol % propane, 0.91 mol % butane and heavier hydrocarbons, and 0.42 mol % nitrogen.

The inlet stream 10 is divided into two streams with stream 202 flowing through gas/gas heat exchanger 21 and inlet chiller 22, and stream 203 flowing through the demethanizer reboiler 23. Gas/gas heat exchanger 21, inlet gas chiller 22, and demethanizer reboiler 23 together comprise inlet cooling train 20 in this example. Gas/gas exchanger 21 utilizes the residue gas leaving the turboexpander plant to cool the inlet stream. This heat exchanger may be shell and tube type heat exchangers or aluminum plate fin heat exchangers, or some equivalent type of heat exchangers. Inlet gas chiller 22 uses a coolant or refrigerant 24 to further cool the inlet stream. Propane is the refrigerant normally used in the chillers of turboexpander plants, however, other refrigerants can be used. Gas/gas exchanger 21 and inlet chiller 22 can also be combined into one heat exchanger with multiple flow paths. More than one Gas/gas exchanger and/or inlet chiller may be used in the practice of the invention, as individual components or combined in one heat exchanger.

Stream 203 is cooled in the demethanizer reboiler 23 by cold liquid streams 62 and 63 withdrawn from demethanizer 61. The concomitant heating of said cold liquid streams by the warm inlet gas stream provides the heat required for proper operation of demethanizer 61. Demethanizer 61 is a fractionator used to remove any methane that may have condensed with the hydrocarbon liquids (e.g. ethane, propane, butane) which are products of the cryogenic plant. In inlet cooling train 20, some of the heavy hydrocarbons condense from the inlet stream 10. Therefore, stream 204, which is made up of the combined streams exiting inlet chiller 22 and demethanizer reboiler 23, will be a two phase stream consisting of liquid and gas.

Stream 204 is introduced into expander inlet separator 30, where the liquid which condensed in inlet cooling train 20 is separated from the gaseous phase. Said liquid fraction is routed to the mid-point of demethanizer 61.

Said gaseous fraction is routed to the expander 40 of turboexpander 41 where the gas is isentropically expanded until it reaches the same pressure as demethanizer 61. In the turboexpander, the shaft of expander 40 is connected to compressor 71 so that the work created during the expansion can be used to drive said compressor 71. The isentropic expansion reduces the temperature of the gas substantially, which causes the ethane and heavy hydrocarbons to condense from the predominantly methane gas, forming a two-phase liquid/gas stream 206. In place of a turboexpander, a JT valve may be used to perform the expansion, though this is less preferred (this alternative is described in Example 2). Said two-phase stream 206 is fed to the top of demethanizer 61. In this example, the enlarged top portion of demethanizer 61 functions as expander outlet separator 50 and the attached lower portion serves as fractionation means 60. The vapors leave the top of the demethanizer as residue (overhead) gas and the liquid fraction is fed to the fractionating section of the demethanizer. Alternatively, a separate expander outlet separator may be installed between the expander and the demethanizer if it is desired to reduce the size of the enlarged top section of the demethanizer.

In this example, the demethanizer overhead gas (residue taken from the top of the demethanizer) is preferably about −160 degrees Fahrenheit, and at a pressure of about 260 psig. In general, the temperature and pressure required will vary depending on the pressure of inlet stream 10, the amount of residue recompression available, and the ethane recoveries required. Temperatures ranging from about −200 degrees to −100 degrees Fahrenheit and pressures of 100 to 600 psig are generally suitable.

The demethanizer overhead is divided into a mainstream 208 and a slipstream 209. Slipstream 209 is routed through residue gas condenser 80 where it is used as a cooling medium during the LNG liquefaction process. Slipstream 209 subsequently rejoins mainstream 208, which is routed to the gas/gas exchanger 21 to cool gas stream 202. The distribution of gas between the slipstream and the mainstream is controlled by temperature control valve 81. In the preferred embodiment of the invention, said valve is controlled so that the temperature to which the LNG is cooled in the residue gas condenser is held constant. For example, control valve 81 may be regulated by software, or it may be controlled by a hard-wired control system. The design and use of such a control system is known to-those of ordinary skill in the art.

Figure 4A:
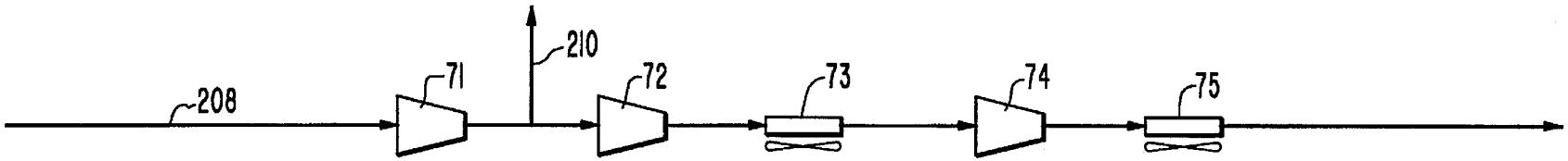
FIG. 4 shows alternative points from which feed gas to the LNG process can be taken in a turboexpander plant (4*a* and 4*b*) or a Joule-Thomson plant (4*c* and 4*d*).
Figure 4B:
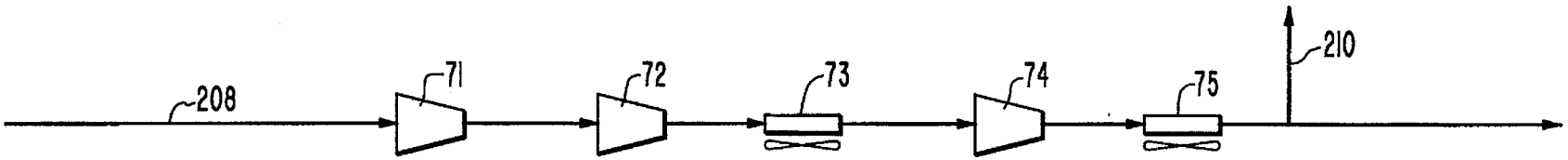

The compression train (70 in FIG. 1) consists of booster compressor 71, which is a part of turboexpander 41, and two additional compression stages. Mainstream gas 208 is compressed in booster compressor 71. The compressed gas which exits booster compressor 71 is compressed in first stage compressor 72 and cooled in first stage aftercooler 73. The first stage discharge gas (output of first stage aftercooler 73) is divided into a slipstream 210 and a mainstream 211. Slipstream 210 serves as the feedstock to residue gas condensor 80, while mainstream 211 is compressed in second stage compressor 74 and cooled in second stage aftercooler 75, following which it is preferably sent to a natural gas pipeline, either directly or after additional recompression, as needed. Condenser feedstock 210 may alternatively be taken from some other point of the compression train, as shown in FIG. 4*a* and 4*b*. It is preferable to take condenser feedstock 210 from the compression train after it has been cooled. In the present example, condenser feedstock 210 has a molar composition of 98.83 mol % methane, 0.70 mol % ethane, 0.02 mol % propane, and 0.45 mol % nitrogen, a temperature of 74 degrees F. and pressure of 445 psig. In a turboexpander plant having a different compression train arrangement than shown here, the condenser feedstock can be taken from any point(s) in the recompression train which provide suitable pressure and temperature levels (see *Condenser Feedstock Pressure, Condensing Temperature*, above). The pressure of condenser feedstock 210 is preferably in the range of about 100 to 1200 psig, and most preferably between about 300 and 900 psig. The temperature is preferably between about 0 and 400 degrees F., and most preferably between about 20 and 200 degrees F.

Condenser feedstock 210 is routed to residue gas condenser 80 where it is liquified under pressure by heat exchange with the demethanizer overhead and flash vapors. Condenser feedstock 210 is preferably cooled to its bubble point. In other embodiments of the invention it may be preferable to cool said condenser feedstock to an even lower temperature (this is termed sub-cooling). In the present example, condenser feedstock 210 was taken after the residue gas from the turboexpander process had undergone one stage of recompression at 445 psig and 74 degrees F. To condense the feedstock to its bubblepoint at 445 psig, the stream needed to be cooled to −138 degrees Fahrenheit. In general, condensed natural gas stream 214 will preferably have a temperature of about −203 to −100 degrees F. and pressure of about 100 to 700 psig, and most preferably of about −159 to −100 degrees F. and pressure of about 300 to 700 psig.

In the preferred embodiment of the invention, residue gas condenser 80 is a brazed aluminum plate fin heat exchanger with multiple flow paths (four in this example). Alternatively, a series of shell and tube heat exchangers may be used instead of a plate fin heat exchanger. The demethanizer overhead slipstream 209 is the main coolant and is used because it has the lowest temperature of any stream in the cryogenic plant and permits the liquefaction of natural gas inlet stream 210 at moderate temperature and pressure. Flash vapor streams 212 and 213 provide supplemental condensing duty and help reduce the amount of demethanizer overhead vapor needed to condense the LNG inlet stream 210.

In the present embodiment of the invention, condensed natural gas stream 214 is isenthalpically expanded or "flashed" across several Joule-Thomson (JT) valves to reduce the temperature and pressure of the condensed liquid, so that it can be conveniently stored or transported. Condensed natural gas stream 214 exiting residue condenser 80 is introduced to high pressure (HP) flash drum 91 via Joule-Thompson (JT) valve 92 (also known as an expansion valve). HP flash drum 91 is a two-phase separator which separates liquid stream 215 and flash vapor stream 212 produced during the expansion or "flash". The HP flash vapors in stream 212 are routed back to the residue gas condenser 80 to serve as supplemental cooling medium, and subsequently to the HP fuel gas line 220 of the plant. The temperature of the gas and liquid in the HP flash drum is −173 degrees F., and the pressure in the HP flash drum is set at 210 psig, as this is the same as the pressure of the HP fuel line of the cryogenic plant, and thus no recompression is required before introducing the flash gas to the HP fuel line. HP flash liquid 215 is routed to low pressure (LP) flash drum 93 via Joule-Thomson (JT) valve 94. The LP flash drum is also a two-phase separator which separates liquid stream 216 and flash vapor stream 213 produced during the flash across JT valve 94. LP flash vapor stream 213 is routed back to residue gas condenser 80 to serve as supplemental cooling and subsequently to the LP fuel line 221 of the cryogenic plant. The pressure in the LP flash drum is set at 78 psig, which is the pressure of the LP fuel line 221 of the plant used in this example, and the temperature is −209 degrees F. Flash drums 91 and 93 are preferably ASME Code, stainless steel pressure vessels which function as two-phase separators to separate the flash vapor from the LNG liquid. The HP and LP flash vapors are concentrated in methane and nitrogen. The HP flash drum vapors are 98.81 mol % methane, 0.95 mol % ethane, 0.03 mol % propane, and 0.21 mol % nitrogen while the LP flash drum vapors are 98.72 mol % methane, 1.17 mol % ethane, 0.03 mol % propane, and 0.08 mol % nitrogen.

The LNG taken from LP flash drum 93 is sent to LNG storage tank 95 via a final Joule Thomson valve 96. The LNG is expanded through said valve to a pressure of between 0.0 and 100 psig and −260 and −245 degrees F., at which it can be readily stored. The LNG product is most preferably at a pressure of 0.5–10 psig and a temperature −258 to −247 degrees Fahrenheit. The vapors 217 formed in the final flash across JT valve 96 are heated in boil-off exchanger 101 and compressed by boil-off compressor 102 and cooled in recooler 103 for use as fuel gas at the gas processing plant or routed to a sales gas pipeline. The total flash vapors generated in the HP flash drum, the LP flash drum, and the storage tank is 0.846 mmscfd. The final LNG product is 98.5 mol % methane, 1.45 mol % ethane, 0.04 mol % propane and 0.01 mol % nitrogen. While it is preferred to return vapors from the flash chambers to the lowest pressure at which the vapors can be used (i.e. in the plant fuel lines), this is not essential to the practice of the invention and the flash vapors could be removed by some other means as well, for example by being burned off or vented to the atmosphere. Alternatively, flash vapor streams 212, 213 and 217 could be recycled, combined with stream 210 and used as feedstock to the LNG liquefaction process. Storage tank 95 can take various forms: storage tanks with capacities less than 70,000 gallons will typically be ASME Code, shop fabricated vessels. These tanks usually have a carbon steel, stainless steel, nickel or aluminum outer shell; a stainless steel, nickel, or aluminum inner shell, and are vacuum jacketed with insulation between the two shells. Tanks larger than 70,000 gallons are usually field erected tanks. Concrete containers are also used.

EXAMPLE 2

Figure 3:
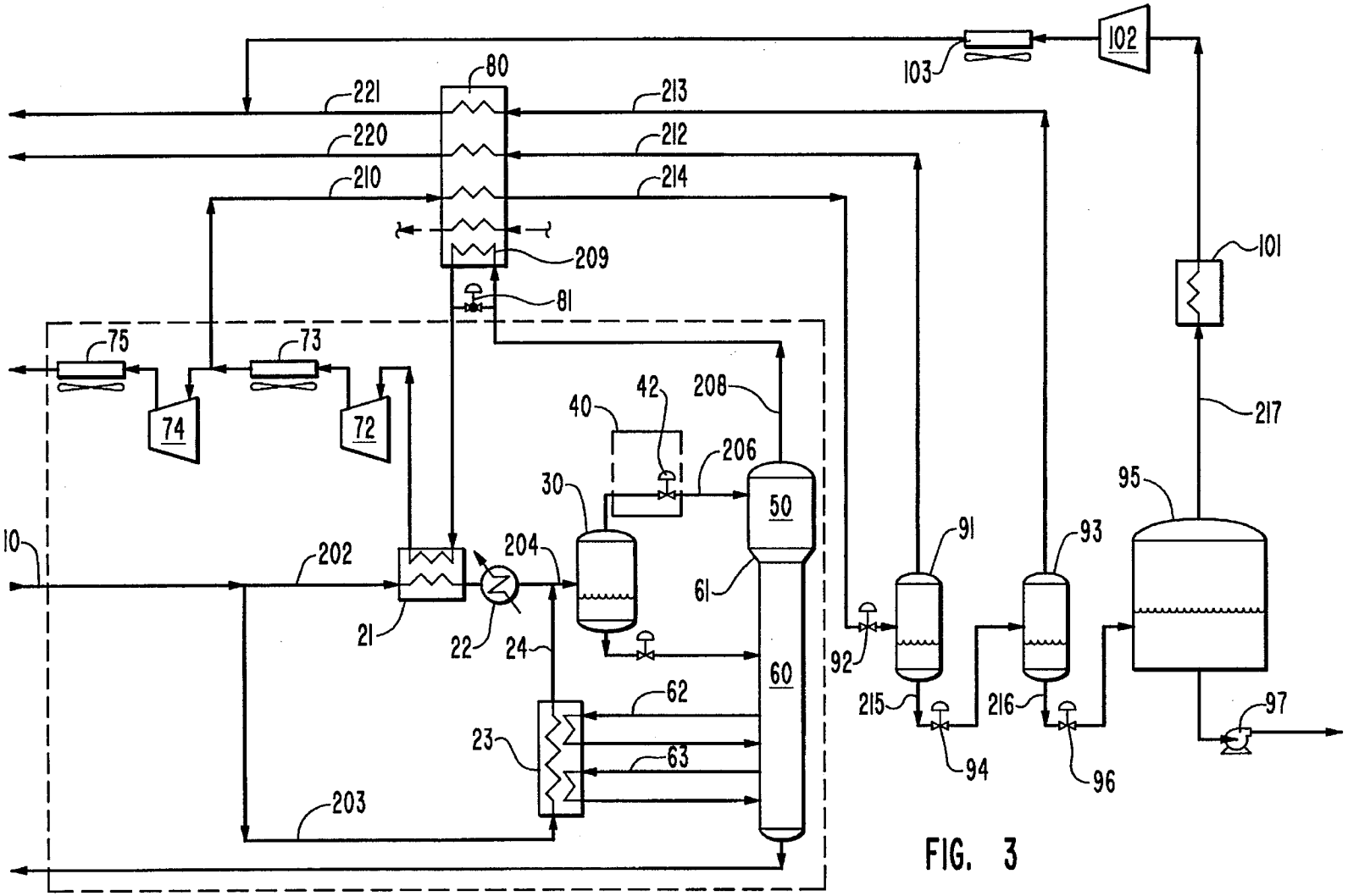
FIG. 3 shows an example of the use of the invention in combination with a JT plant.
Figure 4C:
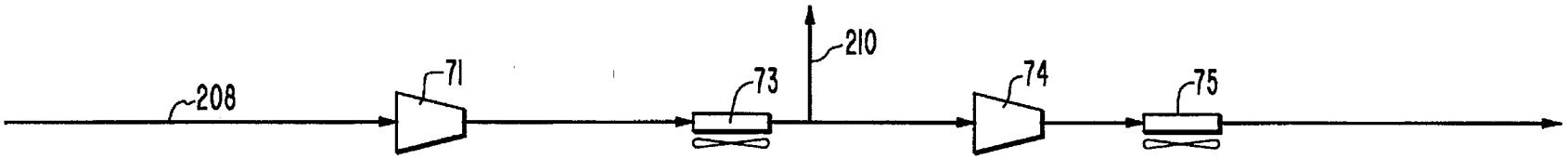
Figure 4D:
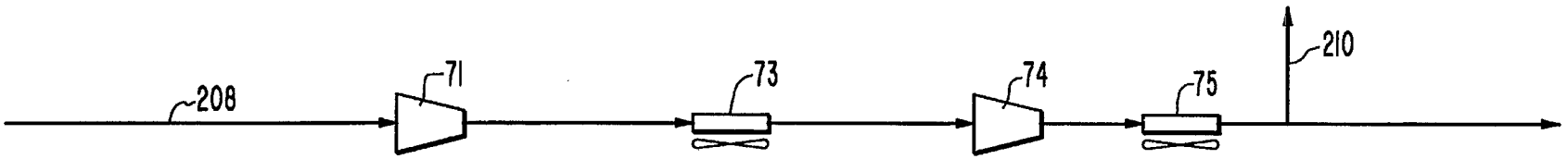

In Example 1 (illustrated in FIG. 2), the invention is integrated with a Turboexpander Plant (TXP). In the present example, the invention is integrated with a type of cryogenic plant known as a Joule-Thomson or JT plant, as shown in FIG. 3. The JT plant shown in FIG. 3 is similar to the TXP shown in FIG. 2, with the difference that as expansion means 40, the JT plant utilizes an expansion or Joule-Thomson (JT) valve 42 in place of the expander used in the TXP to reduce the temperature of the gas stream. As a consequence, the booster compressor portion of the turboexpander is no longer present, and the compression train comprises only compressors 72 and 74 and their associated recoolers 73 and 75. In the case that the JT plant has only one recompressor, condenser feedstock 210 would be taken after recompressor 72 and recooler 73. Alternatively, if the JT plant has two recompression stages (as shown), the condenser feedstock could be taken after the first recompression and recooling steps (see FIG. 4*c*), or after both recompression and cooling steps have been performed, as shown in FIG. 4*d*. Furthermore, if some other compression configuration is used, the condenser feedstock may be taken at any point(s) in the recompression train which provide suitable pressure and temperature levels (see *Condenser Feedstock Pressure, Condensing Temperature*, above). Expansion through a JT valve, as shown in the present example, is an isenthalpic expansion, rather than an isentropic expansion as occurs across a turboexpander. An isentropic expansion removes energy from the gas in the form of external work, whereas an isenthalpic expansion does not remove any energy from the gas. Therefore, using an isenthalpic expansion to reduce the temperature of the inlet gas is less efficient than using an isentropic expansion. The temperatures of the gas exiting the isenthalpic (JT) expansion are higher than the temperatures produced during an isentropic expansion, given the same initial temperature, pressure and outlet pressure conditions. The turboexpander used in Example 1 therefore produces lower temperatures than the JT expander used in the present example, causing more liquids to condense (mostly ethane) which increases the NGL product recovery in the cryogenic plant. Due to the lower ethane recoveries of the JT plant, the JT plant may require modifications to the JT plant inlet cooling train refrigeration system or the addition of an inlet cascade refrigeration system to increase ethane recoveries in order to produce vehicle grade LNG. If the invention is to be used to produce a lower methane purity LNG product (for example in peak shaving application), these refrigeration system modifications probably will not be necessary. A JT expansion, though generally less preferred for efficiency reasons, may be used without departing from the essential nature of the invention.

ALTERNATE EMBODIMENTS OF THE INVENTION

Use of LNG as a Cooling Medium

Figure 5A:
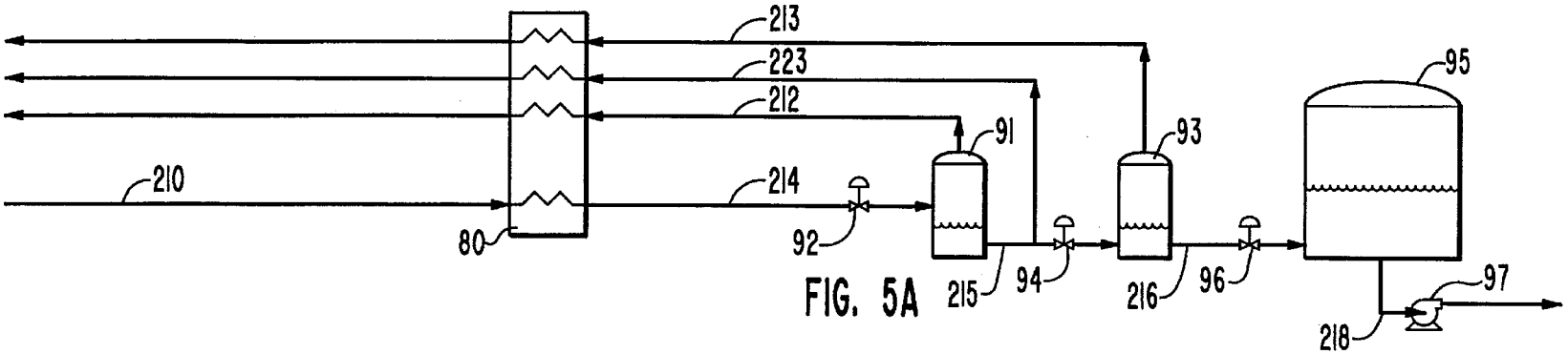
FIG. 5 illustrates the use of LNG taken from (a) the first flash drum, (b) the second flash drum, or (c) the storage tank as coolant in the condenser.
Figure 5B:
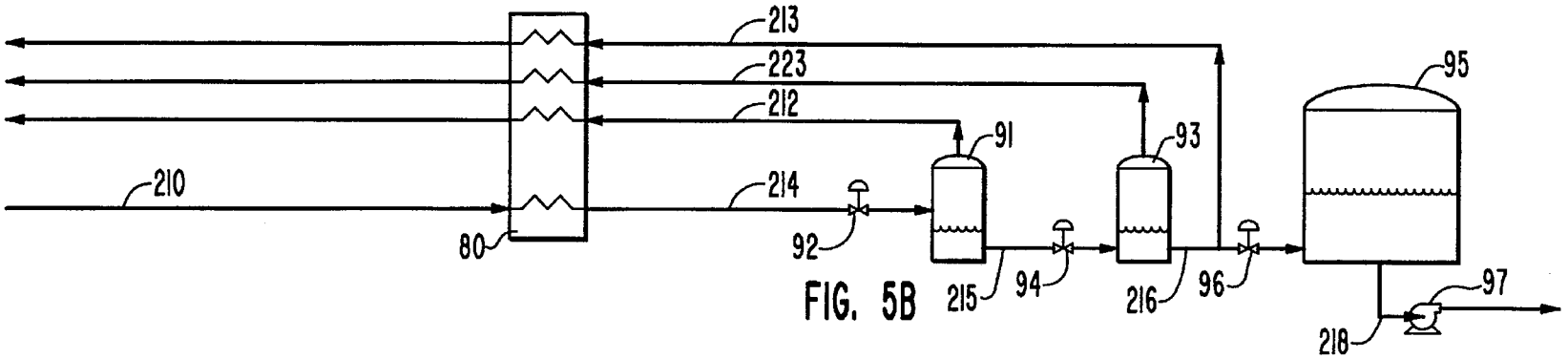
Figure 5C:
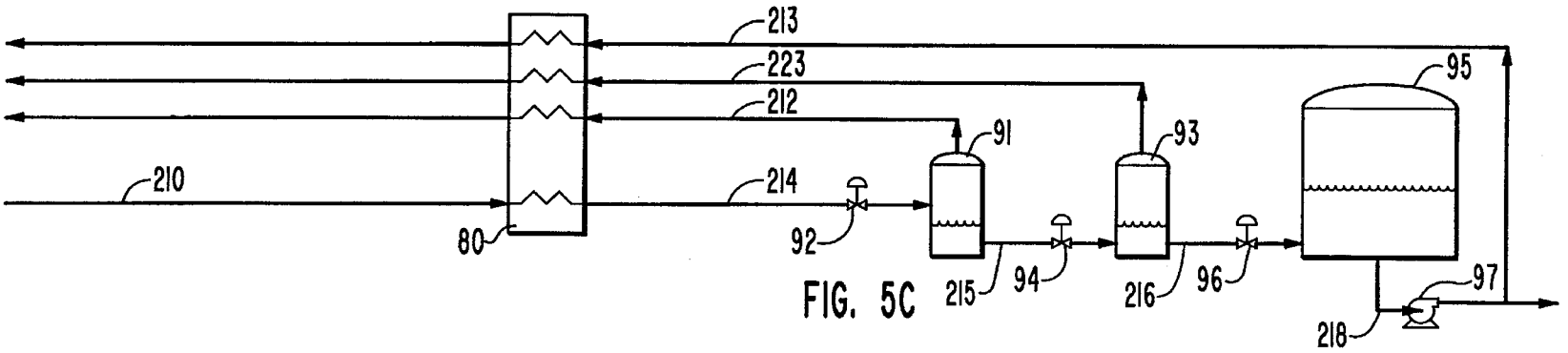

Some of the liquid streams produced in the LNG liquefaction process (i.e. cooled LNG streams) can also be used as cooling media to help condense the LNG feed stream in residue gas condenser 80. For example, a slipstream could be taken from any of the following streams, as shown in FIG. 5:

a) Slipstream 223 from HP Flash Drum Liquid Stream 215. In the plant shown in Example 1, this would have a temperature of −173 degrees F.;

b) Slipstream 224 from LP Flash Drum Liquid Stream 216. In the plant shown in Example 1, this would have a temperature of at −209 degrees F.; or c) Slipstream 225 from storage tank product stream 218. In the plant shown in Example 1, this would have a temperature of −260 degrees F.

One or more of slipstreams 223, 224, or 225 could be routed back to residue gas condenser 80 to help condense the LNG feedstream. This would require that at least one additional flow path be added to the residue gas condenser. The slipstream gasses exiting residue gas condenser 80 could be routed to a plant fuel system, recompressed to pipeline sales gas or recycled into the LNG process at an appropriate place. The slipstream(s) selected as supplemental cooling medium would most likely be colder than the demethanizer overhead stream, so the LNG feedstock could be cooled to a lower temperature than if only the demethanizer overhead stream was used. If the LNG inlet stream is cooled to a much lower temperature, the invention can be integrated at a cryogenic plant where only low pressure LNG feedstocks are available and the demethanizer overhead is not cold enough to liquefy the inlet stream.

The preferred embodiment of the invention is illustrated by Example 1. As noted previously, the preferred embodiment of the invention is partially dependent on the design cryogenic plant with which the invention is to be integrated. Therefore, in addition to the examples presented in which the invention is used in combination with particular cryogenic plant designs, an extensive general description of and guidelines for the implementation of the invention have been provided. While the present invention has been described and illustrated in conjunction with a number of specific embodiments, those skilled in the art will appreciate that variations and modifications may be made without departing from the principles of the invention as herein illustrated, described and claimed. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

I claim:

1. A method for liquifying a natural gas stream, comprising the step of a) cooling and condensing the natural gas stream in a heat exchanger to produce a condensed natural gas stream;

wherein said natural gas stream is in gaseous form and comprises compressed residue gas from a cryogenic plant; wherein said cryogenic plant utilizes a separation means to separate methane gas from liquified heavier hydrocarbons; and wherein cooling is provided in said heat exchanger by a slipstream of said separated methane gas taken as overhead from said separation means.

2. A method in accordance with claim 1, further comprising the step of:

b) expanding said condensed natural gas stream to produce a liquid natural gas product.

3. A method in accordance with claim 2, wherein step b) comprises performing at least one isenthalpic "flash" expansion of said condensed natural gas stream through a Joule-Thomson valve.

4. A method in accordance with claim 2, wherein said compressed residue gas from said cryogenic plant has a pressure of about 100 to 1200 psig and a temperature of about 0 to 400 degrees F.; wherein said condensed natural gas stream has a pressure of about 100 to 700 psig and a temperature of about −203 to −100 degrees F.; and wherein said liquid natural gas product has a pressure of about 0 to 100 psig and a temperature of about −259 to −200 degrees F.

5. A method in accordance with claim 2, wherein said compressed residue gas from said cryogenic plant has a pressure of about 300 to 900 psig and a temperature of about 20 to 200 degrees F.; wherein said condensed natural gas stream has a pressure of about 300 to 700 psig and a temperature of about −159 to −100 degrees F.; and wherein said liquid natural gas product has a pressure of about 0 to 100 psig and a temperature of about −259 to −200 degrees F.

6. A method in accordance with claim 2, wherein step b) comprises the substeps of:

i) performing a first isenthalpic "flash" expansion of said condensed natural gas stream through a first Joule-Thomson valve to produce a first liquid fraction and first vapor fraction;

ii) performing a second isenthalpic "flash" expansion of said first liquid fraction through a second Joule-Thomson valve to produce a second liquid fraction and a second vapor fraction; and iii) performing a third isenthalpic "flash" expansion of said second liquid fraction through a third Joule-Thomson valve to produce a liquid natural gas product and a third vapor fraction.

7. A method in accordance with claim 4 wherein said gas from the overhead of said separation means has a temperature of about −200 to −100 degrees F.

8. A method for liquifying a natural gas stream in accordance with claim 6 wherein at least a portion of at least one of said first vapor fraction, said second vapor fraction, and said third vapor fraction is routed to said heat exchanger for use as an auxilliary cooling medium for providing cooling to said natural gas stream.

9. A method in accordance with claim 8, wherein said compressed residue gas from said cryogenic plant has a pressure of about 100 to 1200 psig and a temperature of about 0 to 400 degrees F.; wherein said condensed natural gas stream has a pressure of about 100 to 700 psig and a temperature of about −203 to −100 degrees F.; and wherein said liquid natural gas product has a pressure of about 0 to 100 psig and a temperature of about −259 to −200 degrees F.

10. A method in accordance with claim 8, wherein said compressed residue gas from said cryogenic plant has a pressure of about 300 to 900 psig and a temperature of about 20 to 200 degrees F.; wherein said condensed natural gas stream has a pressure of about 300 to 700 psig and a temperature of about −159 to −100 degrees F.; and wherein said liquid natural gas product has a pressure of about 0 to 100 psig and a temperature of about −259 to −200 degrees F.

11. A method in accordance with claim 8 wherein said gas from the overhead of said separation means has a temperature of about −200 to −100 degrees F.

12. A process for producing liquid natural gas comprising the steps of:

a) cooling a natural gas feedstock with a cooling means to obtain a cooled liquid/gas mixture;

b) separating said cooled liquid/gas mixture in a separation means to obtain a gas fraction comprising primarily methane and a liquid fraction comprising primarily ethane and heavier hydrocarbons;

c) compressing said gas fraction to obtain a compressed gas fraction; and d) condensing at least a part of said compressed gas fraction via heat exchange with at least a portion of the gas fraction taken from said separation means, to obtain a liquified natural gas fraction;

wherein said natural gas feedstock consists primarily of natural gas in gaseous form.

13. A process in accordance with claim 12, further comprising the step of:

e) expanding said liquified natural gas fraction to reduce the temperature and pressure of said liquified natural gas fraction.

14. The process of claim 13, wherein said separation means comprises a demethanizer and wherein said gas fraction taken from said separation means comprises overhead gasses from said demethanizer.

15. The process of claim 13, wherein said separation means comprises an expander outlet separator and a demethanizer and wherein said gas fraction taken from said separation means comprises overhead gasses from said demethanizer and said expander outlet separator.

16. The process of claim 13, wherein said separation means comprises an expander outlet separator and a demethanizer and wherein said gas fraction taken from said separation means comprises overhead gasses from said demethanizer.

17. A process for producing liquid natural gas comprising the steps of:

a) cooling a natural gas feedstock with a cooling means to obtain a cooled liquid/gas mixture;

b) separating said cooled liquid/gas mixture in a separation means to obtain a gas fraction comprising primarily methane and a liquid fraction comprising primarily ethane and heavier hydrocarbons and a small amount of methane;

c) recovering methane from said liquid fraction with a fractionation means;

d) combining said gas fraction and said methane recovered from said liquid fraction to form a residue gas;

e) compressing said residue gas to obtain a compressed gas fraction;

f) cooling at least a part of said compressed gas fraction via heat exchange with at least a portion of said residue gas to obtain a liquified natural gas/fraction; and g) expanding said liquified natural gas fraction to reduce the temperature and pressure of said liquified natural gas fraction to produce a liquid natural gas product.

18. A process in accordance with claim 17 wherein said fractionation means comprises a demethanizer.

19. A process in accordance with claim 18 wherein said separation means is a liquid/gas separator.

20. A method in accordance with claim 17 wherein said compressed gas fraction has a pressure of about 100 to 1200 psig and a temperature of about 0 to 400 degrees F.; wherein said residue gas has a pressure of about 100 to 600 psig and a temperature of about −200 to −100 degrees F.; wherein said liquified natural gas fraction has a pressure of about 100 to 700 psig and a temperature of about −203 to −100 degrees F.; and wherein said liquid natural gas product has a pressure of about 0 to 100 psig and a temperature of about −259 to −200 degrees F.

21. A method in accordance with claim 17 wherein said compressed gas fraction has a pressure of about 300 to 900 psig and a temperature of about 20 to 200 degrees F.; wherein said residue gas has a pressure of about 100 to 600 psig and a temperature of about −200 to −100 degrees F.; wherein said liquified natural gas fraction has a pressure of about 300 to 700 psig and a temperature of about −159 to −100 degrees F.; and wherein said liquid natural gas product has a pressure of about 0 to 100 psig and a temperature of about −259 to −200 degrees F.

22. A process for producing liquid natural gas comprising the steps of:

a) cooling a natural gas feedstock with a cooling means to obtain a cooled liquid/gas stream;

b) separating said cooled liquid/gas stream into a gaseous fraction and a liquid fraction in an expander inlet separator;

c) performing a first expansion of said gaseous fraction to obtain an expanded gaseous/fraction;

d) introducing said expanded gaseous fraction to a demethanizer;

e) introducing said liquid fraction to said demethanizer;

f) dividing the overhead gasses from said demethanizer into a slipstream and a mainstream;

g) routing said slipstream through a residue gas condenser as a cooling medium;

h) recombining said slipstream and said mainstream to form a residue gas stream;

i) compressing said residue gas stream to obtain a compressed residue gas stream;

j) cooling said compressed residue gas stream to obtain a cooled, compressed gas stream;

k) further cooling at least a part of said cooled, compressed residue gas stream in said residue gas condenser to obtain a condensed residue gas stream; and l) performing a second expansion of said condensed residue gas stream to obtain a liquid natural gas product and a flash vapor fraction.

23. A process in accordance with claim 22, wherein at least a portion of said flash vapor fraction is routed to said residue gas condenser as a coolant.

24. A process in accordance with claim 22, wherein distribution of overhead gas from said demethanizer between said slipstream and said mainstream is regulated by a valve; and wherein the opening of said valve is controlled such that the flow of slipstream gas in said residue gas condenser is sufficient to maintain said condensed residue gas stream at a constant temperature.

25. A process in accordance with claim 22, wherein distribution of demethanizer overhead gas from said demethanizer between said slipstream and said mainstream is regulated by a valve; and wherein the opening of said valve is controlled such that the flow of slipstream gas in said residue gas condenser is sufficient to maintain said condensed residue gas stream at the bubble point of said residue gas stream.

26. A process in accordance with claim 22, wherein distribution of overhead gas from said demethanizer between said slipstream and said mainstream is regulated by a valve; and wherein the opening of said valve is controlled such that the flow of slipstream gas in said residue gas condenser is sufficient to maintain said condensed residue gas stream at a temperature below the bubble point of said residue gas stream.

27. A process in accordance with claim 22 wherein said first expansion comprises isentropic expansion in a turboexpander and said second expansion comprises isenthalpic expansion through at least one Joule-Thomson valve.

28. A process in accordance with claim 22 wherein said first expansion comprises isenthalpic expansion through at least one Joule-Thomson valve and said second expansion comprises isenthalpic expansion through at least one Joule-Thomson valve.

29. A process in accordance with claim 22 wherein said first expansion comprises isenthalpic expansion through at least one Joule-Thompson valve and said second expansion comprises isentropic expansion in a turboexpander.

30. A process in accordance with claim 22 wherein said first expansion comprises isentropic expansion in a turboexpander and said second expansion comprises isentropic expansion in a turboexpander.

31. A process in accordance with claim 22 wherein said cooled, compressed residue gas is at a pressure of about 100 to 680 psig and a temperature of about 0 to 400 degrees Fahrenheit; and wherein said condensed residue gas stream is at a temperature of about −203 to −100 degrees Fahrenheit and a pressure of about 100 to 700 psig.

32. A process in accordance with claim 22 wherein said cooled, compressed residue gas is at a pressure of about 300 to 900 psig and a temperature of about 20 to 200 degrees Fahrenheit; and wherein said condensed residue gas stream is at a temperature of about −159 to −100 degrees Fahrenheit and a pressure of about 300 to 700 psig.

33. A process in accordance in accordance with claim 22 wherein said slipstream has a temperature of about −200 to −100 degrees Fahrenheit.

34. A process in accordance with claim 22 wherein said first expansion comprises isentropic expansion in a turboexpander and wherein said second expansion comprises the following steps:

i) a first isenthalpic expansion of said condensed residue gas stream through a first Joule-Thomson valve into a first flash chamber, forming thereby a first liquid fraction and a first gaseous fraction;

ii) a second isenthalpic expansion of said first liquid fraction through a second Joule-Thomson valve into a second flash chamber, forming thereby a second liquid fraction and a second gaseous fraction; and iii) a third isenthalpic expansion of said second liquid fraction through a third Joule-Thomson valve into a liquid natural gas storage tank, forming thereby a liquid natural gas product and a third gaseous fraction.

35. A process in accordance with claim 31 wherein said slipstream has a temperature of about −200 to −100 degrees F.

36. A process in accordance with claim 32 wherein said slipstream has a temperature of about −200 to −100 degrees F.

37. A process in accordance with claim 34 wherein said process is carried out at least in part in a cryogenic plant, wherein said first liquid fraction has a pressure which is the same as the high pressure fuel line of said cryogenic plant and wherein said second liquid fraction has a pressure which is the same as the low pressure fuel line of said cryogenic plant.

38. A process for producing liquid natural gas comprising the steps of:

a) cooling a natural gas feedstock with a cooling means to obtain a cooled liquid/gas stream;

b) separating said cooled liquid/gas stream into a gaseous fraction and a liquid fraction in an expander inlet separator;

c) performing a first expansion of said gaseous fraction to obtain an expanded gaseous fraction;

d) introducing said expanded gaseous fraction to a demethanizer;

e) introducing said liquid fraction to said demethanizer;

f) fractionating said expanded gaseous fraction and said liquid fraction in said demethanizer to obtain an overhead stream comprising primarily methane in gaseous form and a bottoms stream comprising liquid ethane and heavier hydrocarbons;

g) dividing said overhead stream into a slipstream and a mainstream;

h) routing said slipstream through a residue gas condenser as a cooling medium;

i) recombining said slipstream and said mainstream to form a residue gas stream;

j) compressing said residue gas stream to obtain a compressed residue gas stream;

k) cooling said compressed residue gas stream to obtain a cooled, compressed gas stream;

l) cooling at least part of said cooled, compressed residue gas stream in said residue gas condenser to obtain a condensed residue gas stream; and m) performing a second expansion of said condensed residue gas stream to obtain a liquid natural gas product and a flash vapor fraction.

39. A process in accordance with claim 38, wherein said overhead stream has a temperature of about −200 to −100 degrees F., and a pressure of about 100 to 600 psig, wherein said compressed residue gas has a temperature of 0 to 400 degrees F., and a pressure of 100 to 1200 psig; and wherein said liquid natural gas product has a temperature of −259 to −200 degrees F., and a pressure of 0 to 100 psig.

40. A process in accordance with claim 38, wherein said overhead stream has a temperature of −200 to −100 degrees F., and a pressure of 100 to 600 psig; wherein said compressed residue gas has a temperature of 20 to 200 degrees F., and a pressure of 300 to 900 psig; and wherein said liquid natural gas product has a temperature of −259 to −200 degrees F., and a pressure of about 0 to about 100 psig.

41. A process in accordance with claim 38, wherein said cooled, compressed gas stream is sub-cooled to produce a condensed residue gas stream which has been cooled to below its bubble point.

42. A process in accordance with claim 38, wherein said second expansion comprises the following steps:

i) a first isenthalpic expansion comprising expansion of said condensed residue gas stream through a first Joule-Thomson valve into a first flash chamber, forming thereby a first liquid fraction and a first gaseous fraction;

ii) a second isenthalpic expansion of said first liquid fraction through a second Joule-Thomson valve into a second flash chamber, forming thereby a second liquid fraction and a second gaseous fraction; and iii) a third isenthalpic expansion of said second liquid fraction through a third Joule-Thomson valve into a liquid natural gas storage tank, forming thereby a liquid natural gas product and a third gaseous fraction.

43. A process in accordance with claim 42, wherein at least a portion of at least one of said first gaseous fraction, said second gaseous fraction, and said third gaseous fraction, is returned to said residue gas condenser to serve as an auxiliary cooling medium.

44. A process in accordance with claim 42, wherein at least a portion of at least one of said first liquid fraction, said second liquid fraction, and said liquid natural gas product is returned to said residue gas condenser to serve as auxiliary cooling medium.

45. An apparatus for liquifying a natural gas stream, comprising:

a) a heat exchanger; wherein the natural gas stream comprises compressed residue gas from a cryogenic plant; wherein said cryogenic plant utilizes a separation means; wherein cooling is provided in said heat exchanger by a slipstream of gas taken from the overhead of said separation means; and wherein the cooling provided by said heat exchanger is sufficient to condense said natural gas stream to produce a liquid natural gas stream.

46. An apparatus in accordance with claim 45, further comprising:

b) an expansion means;

wherein the pressure and temperature of said liquid natural gas stream are reduced to a level suitable for storage and transportation by expansion of said condensed natural gas stream in said expansion means.

47. An apparatus as in claim 46 wherein said expansion means comprises at least one Joule-Thomson valve.

48. An apparatus in accordance with claim 46, wherein said expansion means comprises a turboexpander.

49. An apparatus in accordance with claim 46 wherein said expansion means comprises:

i) a first Joule-Thomson valve;

ii) a first flash chamber;

iii) a second Joule-Thomson valve;

iv) a second flash chamber;

v) a third Joule-Thomson valve; and vi) a liquid natural gas storage tank;

wherein said compressed natural gas stream is expanded into said first flash chamber through said first Joule-Thomson valve to produce a first liquid fraction and a first gaseous fraction; wherein said first liquid fraction is expanded into said second flash chamber through said second Joule-Thomson valve to produce a second liquid fraction and a second gaseous fraction; and wherein said second liquid fraction is expanded into said liquid natural gas storage tank through said third Joule-Thomson valve to produce a liquid natural gas product and a third gaseous fraction.

50. An apparatus in accordance with claim 49 wherein said heat exchanger has multiple flow channels to accomodate said natural gas stream, said slipstream of gas taken from the overhead of said separation means and at least one supplementary cooling medium stream.

51. An apparatus for producing liquid natural gas comprising:

a) a cooling means;

b) a separation means;

c) a compression means;

d) a heat exchanger; and e) an expansion means;

wherein a natural gas feedstock is cooled in said cooling means to produce a cooled liquid/gas mixture; wherein said cooled liquid/gas mixture is separated in said separation means into a gas fraction comprising primarily methane and a liquid fraction comprising primarily ethane and heavier hydrocarbons; wherein at least a portion of said gas fraction is routed through said heat exchanger where it serves as a cooling medium, and subsequently through said compression means where it is compressed to form a compressed gas fraction; wherein said compressed gas fraction is cooled in said heat exchanger such that it is condensed to a liquid; and wherein said liquid is expanded in said expansion means, thereby reducing the temperature and pressure of said liquid, to form a liquid natural gas product.

52. An apparatus in accordance with claim 51 wherein said expansion means comprises at least one Joule-Thomson valve.

53. An apparatus in a accordance with claim 51 wherein said expansion means comprises a turboexpander.

54. An apparatus in a accordance with claim 51 wherein said expansion means comprises:

i) a first Joule-Thomson valve;

ii) a first flash chamber;

iii) a second Joule-Thomson valve;

iv) a second flash chamber;

v) a third Joule-Thomson valve; and vi) a liquid natural gas storage tank;

wherein said compressed natural gas stream is expanded into said first flash chamber through said first Joule-Thomson valve to produce a first liquid fraction and a first gaseous fraction; wherein said first liquid fraction is expanded into said second flash chamber through said second Joule-Thomson valve to produce a second liquid fraction and a second gaseous fraction; and wherein said second liquid fraction is expanded into said liquid natural gas storage tank through said third Joule-Thomson valve to produce a liquid natural gas product and a third gaseous fraction.

55. An apparatus for producing liquid natural gas:

a) a cooling means;

b) a liquid/gas separator;

c) a first expansion means;

d) a demethanizer;

e) a compression means;

g) a residue gas condenser; and h) a second expansion means;

wherein a natural gas feedstock is cooled in said cooling means to produce a cooled liquid/gas mixture; wherein said cooled liquid/gas mixture is separated in said liquid/gas separator into a first gas fraction and a first liquid fraction; wherein said gas fraction is expanded in said first expansion means to form a second liquid/gas mixture; wherein said first liquid fraction and said liquid/gas mixture are introduced to said demethanizer, in which they are fractionated to obtain an overhead gas comprising primarily methane and a bottoms stream comprising primarily liquid ethane and heavier hydrocarbons; wherein at least a portion of said overhead gas is routed through said heat exchanger where it serves as a cooling medium, and subsequently through said compression means where it is compressed to form a compressed gas fraction; wherein said compressed gas fraction is cooled in said heat exchanger such that it is condensed to a liquid; and wherein said liquid is expanded in said expansion means, thereby reducing the temperature and pressure of said liquid, to form a liquid natural gas product.

56. An apparatus in accordance with claim 55 wherein said expansion means comprises at least one Joule-Thomson valve.

57. An apparatus in a accordance with claim 55 wherein said expansion means comprises a turboexpander.

58. An apparatus in a accordance with claim 55 wherein said expansion means comprises:

i) first Joule-Thomson valve;

ii) a first flash chamber;

iii) a second Joule-Thomson valve;

iv) a second flash chamber;

v) a third Joule-Thomson valve; and vi) a liquid natural gas storage tank;

wherein said compressed natural gas stream is expanded into said first flash chamber through said first Joule-Thomson valve to produce a first liquid fraction and a first gaseous fraction; wherein said first liquid fraction is expanded into said second flash chamber through said second Joule-Thomson valve to produce a second liquid fraction and a second gaseous fraction; and wherein said second liquid fraction is expanded into said liquid natural gas storage tank through said third Joule-Thomson valve to produce a liquid natural gas product and a third gaseous fraction.

59. An apparatus in accordance with claim 55 wherein said heat exchanger has multiple flow channels to accomodate said natural gas stream, said slipstream of gas taken from the overhead of said separation means and at least one supplementary cooling medium stream.

* * * * *